United States Patent [19]

Allais et al.

[11] Patent Number: 4,970,938

[45] Date of Patent: Nov. 20, 1990

[54] MECHANICAL SERVOSYSTEM FOR OPTICAL AIMING DEVICE

[75] Inventors: Jean-Philippe P. B. Allais, Fontaine la Mallet; Alain R. Guillermond, Maneglise; Pascal G. Rouyer, Le Havre, all of France

[73] Assignee: Societe Nationale d'Etude et de Construction de Moteurs d'Aviation, Evry Cedex, France

[21] Appl. No.: 375,912

[22] Filed: Jul. 6, 1989

[30] Foreign Application Priority Data

Jul. 7, 1988 [FR] France ..... 88 09200

[51] Int. Cl.[5] ..... F41G 3/02; F41G 3/22; F41G 5/02

[52] U.S. Cl. ..... 89/41.190; 89/36.140; 350/540

[58] Field of Search ..... 89/36.14, 41.19; 350/500, 540, 592, 543, 544, 623; 356/253, 254, 255

[56] References Cited

U.S. PATENT DOCUMENTS

| | | | |
|---|---|---|---|
| 683,204 | 9/1901 | Grubb | 89/41.19 |
| 2,390,516 | 12/1941 | Crawford | 356/254 |
| 3,466,968 | 9/1969 | Stangl et al. | 89/41.19 |
| 4,409,861 | 10/1983 | Sukurai | 74/501.6 |

FOREIGN PATENT DOCUMENTS

| | | | |
|---|---|---|---|
| 1807430 | 1/1915 | Fed. Rep. of Germany . | |
| 3231026 | 4/1984 | Fed. Rep. of Germany . | |
| 2396946 | 2/1979 | France . | |
| 2421362 | 10/1979 | France . | |
| 450982 | 4/1950 | Italy | 350/623 |
| 1205369 | 9/1969 | United Kingdom . | |
| 2198505 | 6/1988 | United Kingdom . | |

*Primary Examiner*—Stephen C. Bentley
*Attorney, Agent, or Firm*—Bacon & Thomas

[57] ABSTRACT

A mechanical servosystem for connecting the pivoting weapon support to an optical aiming device such that the optical sighting axis remain in alignment with the elevation of the weapon is described. A motion input mechanism is connected to the pivoting weapons mounting. The optical device is connected to a mechanical motion output mechanism which, in turn, is connected to the motion input mechanism via a flexible motion transmission device. A linkage interconnects the weapon mounting with the motion input mechanism such that any elevational movement of the weapon is automatically transferred to the optical aiming device to maintain the alignment of the optical axis with the weapon.

7 Claims, 6 Drawing Sheets

MECHANICAL SERVOSYSTEM FOR OPTICAL AIMING DEVICE

BACKGROUND OF THE INVENTION

The present invention relates to a mechanical servosystem to maintain an optical aiming device having an optical axis in alignment with a weapon as the weapon undergoes elevational movement.

In an armored vehicle having a turret movable about a generally vertical axis with respect to the vehicle body, the turret may have a mounting system thereon for attaching weapons externally to the turret. The weapon mounting device is capable of pivoting about a lateral axis extending across the turret so as to elevate the weapon.

A sight is provided within the turret for the gunner to aim the weapon and, quite obviously, the optical axis of the sight must be kept in alignment with the elevation of the external weapon.

French patent No. 2,396,946 discloses a system wherein a mirror transmitting the sight axis rotates to follow the elevation motion of a weapon. However, in this particular instance, the mirror is located near the pivotal axis of the weapon and, therefore, the interconnection of the mirror and the weapon elevational system does not pose any significant problems.

French patent No. 2,421,362 describes a servosystem for elevation of a sighting means by means of link rods cooperating with gear-rack systems. This results in a complex mechanical system that is impractical within the small space confines of an armored vehicle turret. This system, as well as the previous system, has not been applicable to such a turret, wherein the pivoting axis of the weapon extends laterally across the rear portion of the turret and the optical aiming device is located in a forward position of the turret.

SUMMARY OF THE INVENTION

The present invention relates to a mechanical servosystem for connecting a pivoting weapon support to an optical aiming device such that the optical sighting axis remains in alignment with the elevation of the weapon.

The invention finds particular usage in a turret of an armored vehicle wherein the pivoting axis of the weapon is located toward the rear of the turret and the optical sighting means is located in a forward portion of the turret.

A motion input mechanism is connected to the pivoting weapon mounting. The optical device is connected to a mechanical motion output mechanism which, in turn, is connected to the motion input mechanism via a flexible motion transmission device. A linkage interconnects the weapon mounting with the motion input mechanism such that any elevational movement of the weapon is automatically transferred to the optical aiming device to maintain the alignment of the optical axis with the weapon.

DETAILED DESCRIPTION OF THE PREFERRED EMBODIMENT

Figure 1:
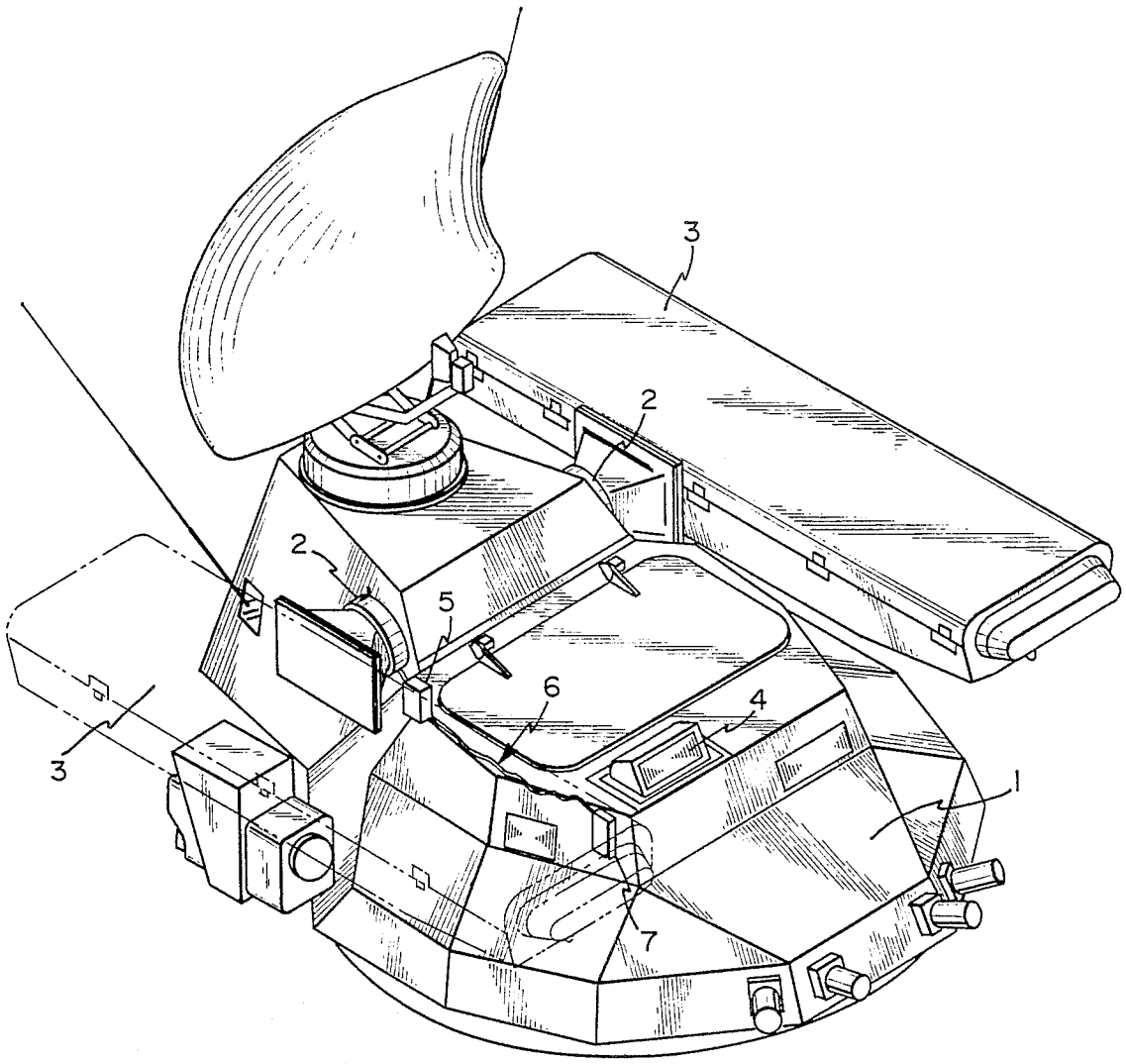
FIG. 1 is a perspective view showing an armored vehicle turret equipped with the mechanical servosystem according to the invention.

FIG. 1 illustrates the turret 1 of an armored vehicle (not shown) which is movable about a generally vertically extending axis with respect to the armored vehicle. Turret 1 has an externally mounted weapon 3 attached to a journal mounting mechanism 2 so as to pivot about an axis extending generally laterally across a rear portion of the turret 1. Pivoting about this axis elevates the weapon 3.

In order to aim the weapon, the gunner inside the turret is provided with an optical aiming device 4 located near the front of the turret 1. The optical aiming device 4 may include a telescope or a periscope-type optical device.

In order to synchronize the elevational displacement of the optical axis of the optical aiming device with the elevational displacement of the weapon 3, the present invention provides a mechanical servosystem interconnecting these elements so that the elevational motion of the weapon is automatically imparted to the optical aiming device.

The mechanical servosystem includes a motion input mechanism 5 located near the rear of the turret adjacent to the journal 2, a motion output mechanism 7 connected to the optical aiming device 4 and a flexible motion transmission device 6 interconnecting the input mechanism 5 and the output mechanism 7.

Figure 2:
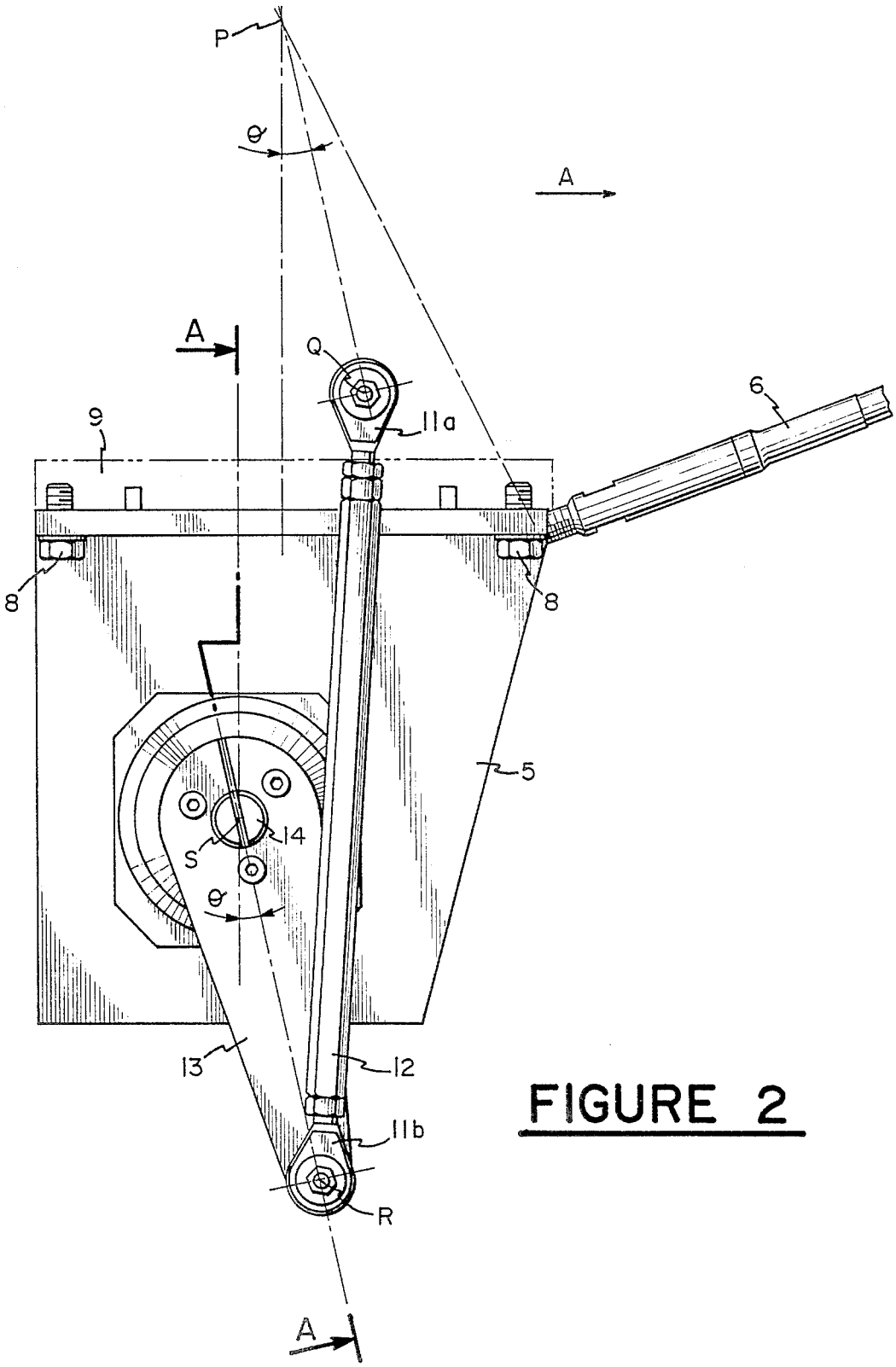
FIG. 2 is a side view of the motion input mechanism according to the invention.
Figure 3:
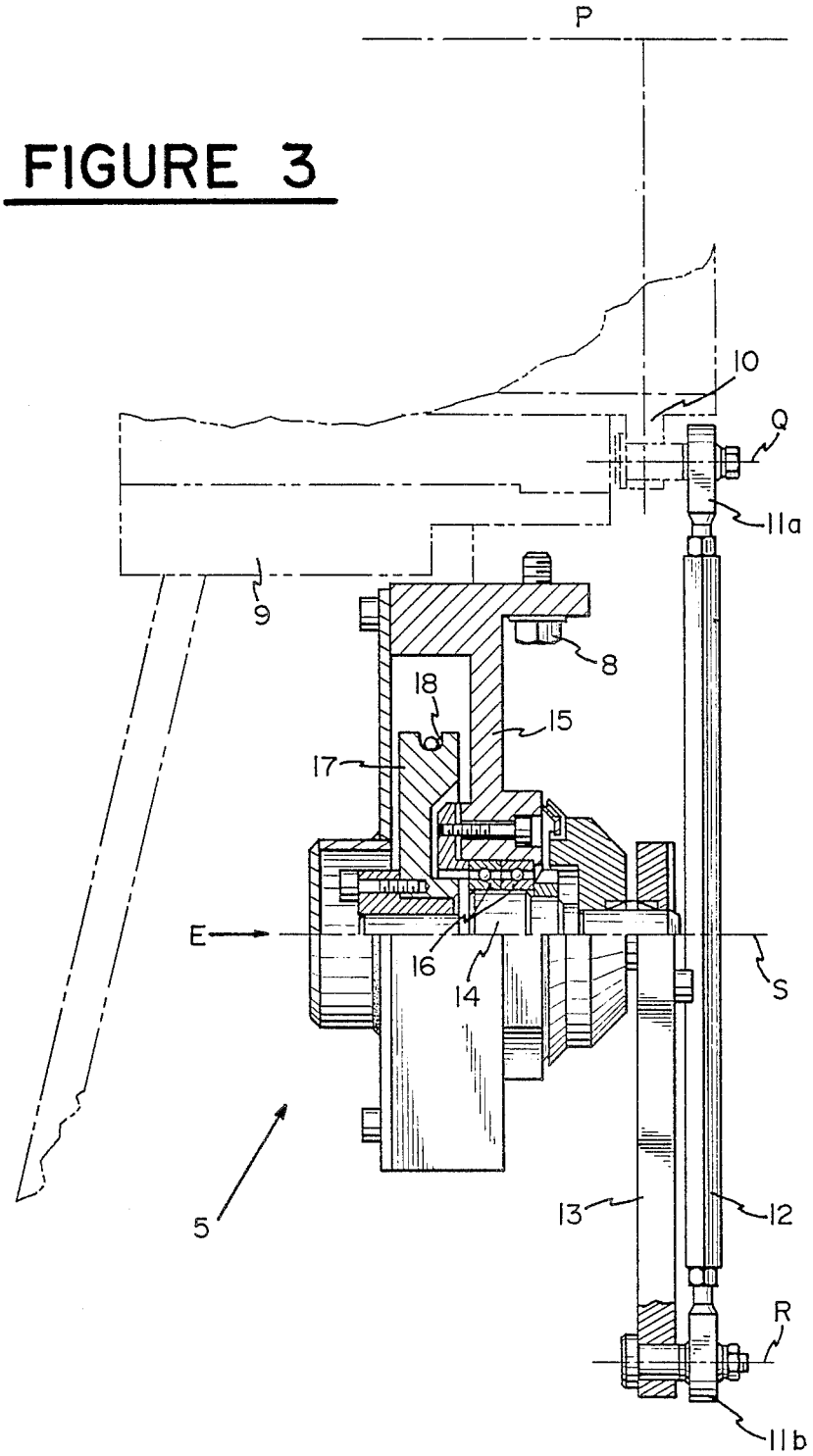
FIG. 3 is a partial cross-sectional view taken along line A—A in FIG. 2.
Figure 4:
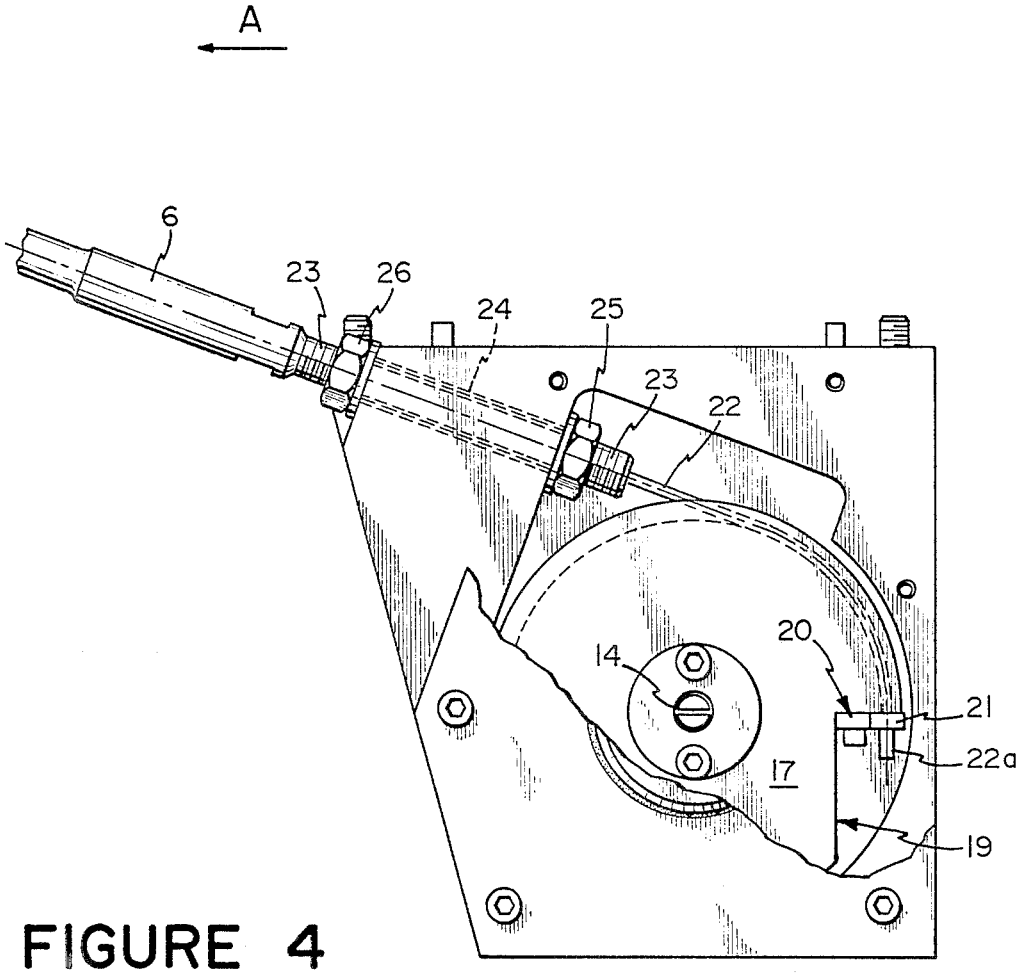
FIG. 4 is a side view taken in the direction of arrow E in FIG. 3.

The details of the motion input mechanism 5 are shown in FIGS. 2–4. The mechanism is mounted within a body 15 attached by bolts 8 to the body 9 of the turret 1 near the journal 2, having an axis of rotation P. As best seen in FIG. 2, the points P, Q, R and S form the apexes of a deforming parallelogram linkage such that rotation of line PQ about the axis P imparts corresponding rotation to line SR. Thus, movement of line PQ through an angle $\theta$ will cause line SR to also move through the angle $\theta$.

Point Q is located on a component 10 fixedly joined to the weapon mounting system. Thus, as the weapon mounting system rotates about journal 2 and about axis P, point Q will also move about axis P.

Adjustable length link rod 12 is attached between points Q and R via swivel head attachments 11*a* and 11*b*. Point R is located at one end of link rod 13, the other end of which is connected to shaft 14, extending from pulley 17. Thus, as can be seen, rotation of line PQ through angle $\theta$ will cause the corresponding movement of link rod 13 through this angle to thereby cause rotation of shaft 14 about an axis extending through point S parallel to axis P.

Shaft 14 is rotationally supported in body 15 of the motion input mechanism 5 by ball bearings 16. Shaft 14 is fixedly attached to pulley 17 which defines a circumferential groove 18 and a notched, cutout portion 19. Cutout portion 19 defines a radially extending surface 20 to which is clamped the end of a cable 22 by clamping device 21. The end is also fitted with a projecting stop 22a which may be crimped onto the end of cable 22.

Cable 22 forms one end of a flexible motion transmission device 6 comprising a sheath having a threaded end 23 fixed in a bore 24 defined by mounting body 15 by nuts 25 and 6. The flexible motion transmission device 26 may also include a cable extending slidably through the sheath, or may comprise a metal band extending through the sheath having a plurality of balls interposed between the interior of the sheath and the metal band as illustrated in FIG. 4a. Cable 22 may be attached to one end of the metal band by any known means.

The flexible motion transmission device 6 is preferably located within the interior of the turret so as to be protected by the turret armor. However, the device 6 may also be located on the exterior of the turret, if the mechanical servosystem is mounted on existing turrets.

Figure 5:
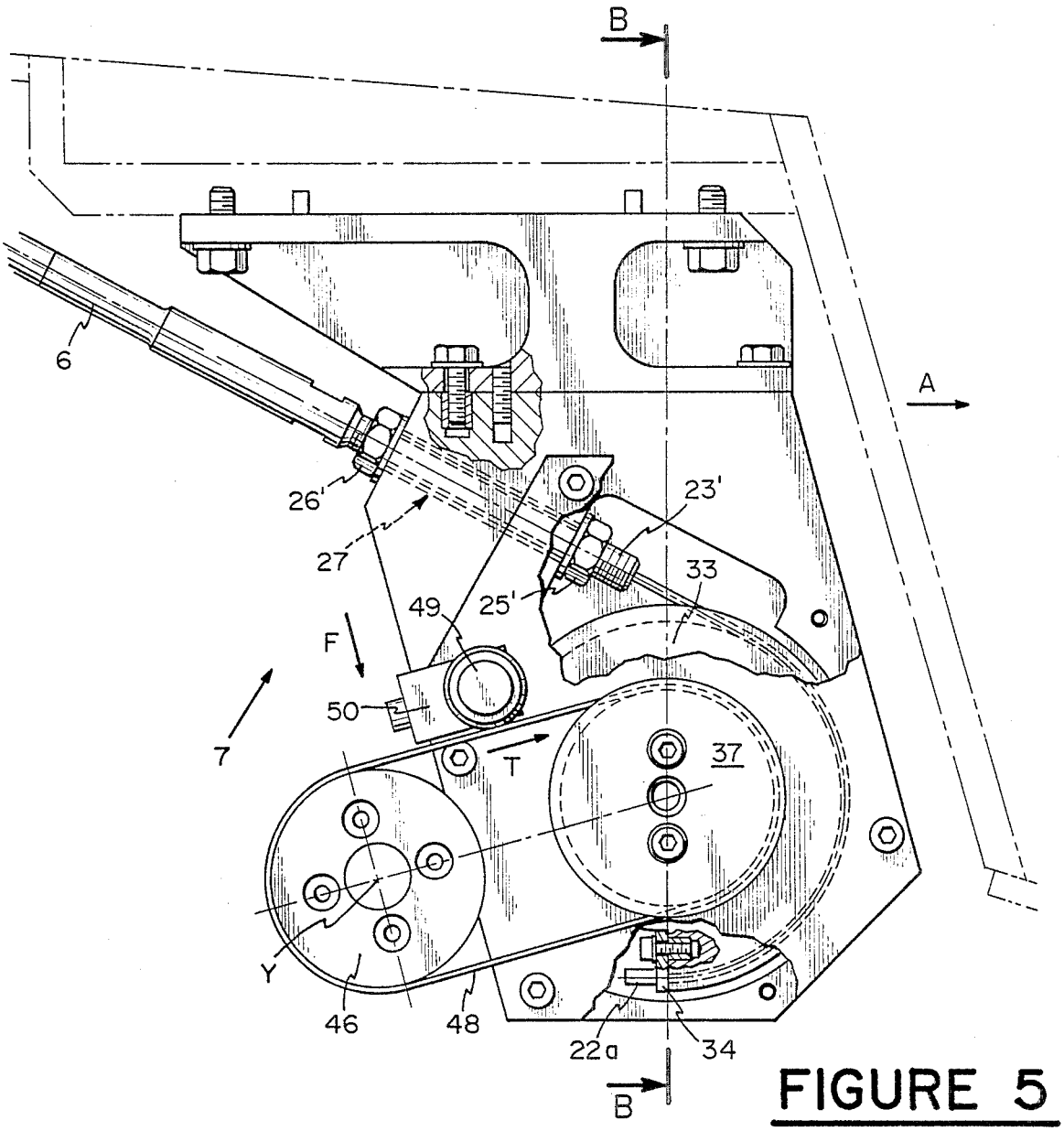
FIG. 5 is a side view of the motion output mechanism according to the invention.

As seen in FIG. 5, the other end of the flexible motion transmission device 6 passes through a bore 27 defined by body 28 of the motion output mechanism 7. The end of the sheath may be retained in position by nuts 25' and 26'.

The motion output mechanism 7 comprises a hollow mounting body 28 in which a main side wall 29 defines a bore 30 therethrough. A shaft 32 fixedly attached to a grooved pulley 33 is mounted inside the bore 30 by bearings 31. Nut 39 engages shaft 32 and bore 30 to prevent any lateral movement of the shaft 32. Expansible collar 35 extends between shaft 32 and pulley 33 and serves to fixedly attach these elements together.

The other end of cable 22 is attached to pulley 33 in an identical fashion to that described in relation to pulley 17.

The hollow portion of body 28 is closed by cover 36, through which the shaft 32 and the expansible collar 35 extend. The exposed end of shaft 32 is external to the cover 36 and has mounted thereon a drive gear 37, which may be fixed to collar 35. A disk 38, having a diameter larger than that of the drive gear 37 is mounted on its exterior side to provide a lip to prevent the disengagement of an endless drive belt.

The opposite end of shaft 32 extends into an ancillary box 40 fastened to the wall 29 of the body 28. A spiral spring 42 has one end fixedly attached to the box at 41, while the inner end of the spring enters a radial slot 43, formed in shaft 32. Spring 42 exerts a biasing force on the shaft and, consequently, the pulley 33 to maintain a tension on the cable 22.

Figure 6:
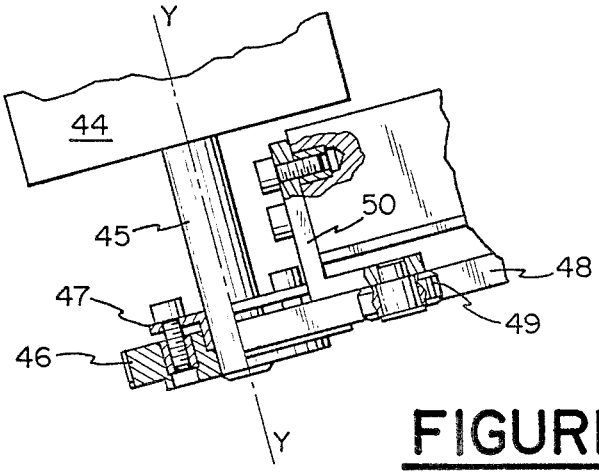
FIG. 6 is a partial view taken in the direction of arrow F in FIG. 5.
Figure 7:
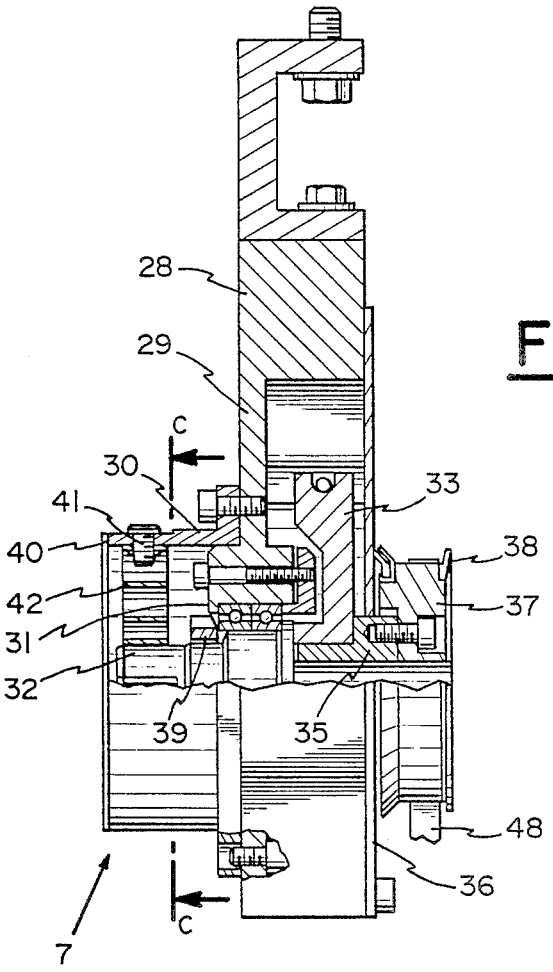
FIG. 7 is a partial, sectional view taken along line B—B in FIG. 5.
Figure 8:
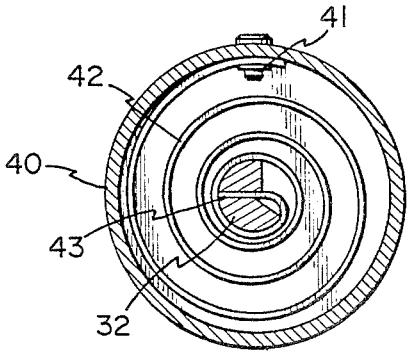
FIG. 8 is a cross-sectional view taken along line C—C in FIG. 7.

The optical aiming device 44 is partially shown in FIG. 6 along with its interconnection to drive gear 37. Its axis of rotation YY extends through a pivoting shaft 45 on which is mounted a driving gear 46 by clamping collar 47. Drive gear 46 is connected to drive gear 37 by an endless toothed belt 48. Endless belt 48 may be tensioned by tensioning roller 49 attached to support 50 which, in turn, is mounted on the body 28.

As can be readily seen, the elevational pivoting movement of the journal 2 will impart a rotation to pulley 17 through link rods 12 and 13. This pivoting movement will exert a tension force on cable 22 which, in turn, will cause pulley 33 to move about its rotational axis. Such movement causes partial rotation of drive gears 37 and 46 which, in turn, cause the optical aiming device 44 to pivot about its axis YY.

The kinematics for the mechanical servosystem according to the invention allow an accuracy of elevational angles of $2\times10^{-3}$ radians for a range of weapon elevations from $-8°$ to $+40°$.

In an alternative, simplified version, the deforming parallelogram linkage can be eliminated and the input pulley 17 may be attached directly to the weapon elevating system so as to rotate about axis P. Similarly, if the distance between the shaft 32 and the optical aiming device 44 is sufficiently short, these elements may be linked by a coupling sleeve or other link means and the drive belt 48 may be eliminated.

The system according to the invention is applicable equally to the turrets of armored vehicles undergoing construction and for retrofit on existing armored vehicles. The system may also be utilized to interconnect two optical aiming devices, one for the gunner and one for the vehicle crew chief. The system is furthermore applicable to gun carriages or firing stations wherein the aiming system is not rigidly linked to the weapon support. The system according to the invention may be utilized anywhere that precise reproduction of angular positions are required wherein known electronic systems would be inadequate.

The foregoing description is provided for illustrative purposes only and should not be construed as in any way limiting this invention, the scope of which is defined solely by the appended claims.

What is claimed is:

1. In an armored vehicle turret having a weapon system mounted externally so as to be movable in elevation about an axis extending across the rear of the turret, a mechanical servosystem to maintain an optical aiming device having an optical axis in alignment with the weapon comprising:

(a) a motion input mechanism located on the turret near the axis of movement of the weapon, the input mechanism comprising:
  (i) an input pulley rotatably mounted on the turret, the input pulley having an input shaft;
  (ii) means connecting the input shaft to the weapon system comprising a deforming parallelogram linkage including a first link rod attached to the input shaft and a second link rod connected to the first link rod and the weapon system; and,
  (iii) means connecting a first end of the flexible motion transmission device to the input pulley;
(b) a motion output mechanism;
(c) first means interconnecting the motion input means to the weapon system such that elevational motion of the weapon about its axis is imparted to the motion input mechanism;
(d) a flexible motion transmission device interconnecting the motion input mechanism to the motion output mechanism; and,
(e) second means interconnecting the motion output mechanism to the optical aiming device such that elevational motion of the weapon is transmitted from the motion input mechanism, through the flexible motion transmission device, to the motion output mechanism to maintain the optical axis in alignment with the weapons elevational position.

2. The mechanical servosystem according to claim 1 wherein the length of the second linkrod is adjustable.

3. The mechanical servosystem according to claim 1 wherein the motion output mechanism comprises:

(a) a second pulley rotatably supported on the turret, the second pulley having an output shaft;
(b) means connecting the output shaft to the optical device; and, (c) means interconnecting the second pulley to a second end of the flexible motion transmission device.

4. The mechanical servosystem according to claim 3 wherein the means connecting the output shaft to the optical device comprises:

(a) a first drive gear attached to the output shaft;

(b) a second drive gear attached to the optical device; and, (c) endless belt drive means engaging the first and second drive gears.

5. The mechanical servosystem according to claim 4 further comprising a tensioning roller bearing against the endless belt drive means.

6. The mechanical servosystem according to claim 3 further comprising spring means connected to the second pulley to exert a biasing force thereon to maintain tension in the flexible motion transmission device.

7. The mechanical servosystem according to claim 1 wherein the flexible motion transmission device comprises:

(a) a fixed, flexible sheath;

(b) a cable slidably mounted within the sheath; and, (c) means to connect ends of the cable to the motion input mechanism and to the motion output mechanism.

* * * * *

UNITED STATES PATENT AND TRADEMARK OFFICE

CERTIFICATE OF CORRECTION

PATENT NO. : 4,970,938

DATED : November 20, 1990

INVENTOR(S) : ALLAIS et al.

It is certified that error appears in the above-identified patent and that said Letters Patent is hereby corrected as shown below:

On the title page, item [73], should be changed to read as follows:

--Societe anonyme dite HISPANO-SUIZA, Saint-Cloud, France--

Column 3, line 7, "6" should be --26--;
lines 11-12 "as illustrated in FIG. 4a" should be deleted.

Signed and Sealed this

Sixteenth Day of March, 1993

*Attest:*

STEPHEN G. KUNIN

*Attesting Officer*

*Acting Commissioner of Patents and Trademarks*